US009264802B2

(12) United States Patent
Ooi et al.

(10) Patent No.: US 9,264,802 B2
(45) Date of Patent: Feb. 16, 2016

(54) COMPUTING DEVICE UTILIZING A RESTING SURFACE AS A SPEAKER

(71) Applicant: Google Inc., Mountain View, CA (US)

(72) Inventors: Leng Ooi, San Jose, CA (US); Jeffrey Hayashida, San Francisco, CA (US)

(73) Assignee: Google Inc., Mountain View, CA (US)

( * ) Notice: Subject to any disclaimer, the term of this patent is extended or adjusted under 35 U.S.C. 154(b) by 407 days.

(21) Appl. No.: 13/713,904

(22) Filed: Dec. 13, 2012

(65) Prior Publication Data

US 2015/0201273 A1 Jul. 16, 2015

(51) Int. Cl.
*H04R 3/00* (2006.01)

(52) U.S. Cl.
CPC ..... *H04R 3/00* (2013.01)

(58) Field of Classification Search
USPC ..... 381/152
See application file for complete search history.

(56) References Cited

U.S. PATENT DOCUMENTS

| | | | | |
|---|---|---|---|---|
| 4,439,640 | A | 3/1984 | Takaya | |
| 5,796,854 | A | 8/1998 | Markow | |
| 6,243,473 | B1 | 6/2001 | Azima et al. | |
| 6,304,434 | B1 | 10/2001 | Markow | |
| 6,600,929 | B1 * | 7/2003 | Toncich et al. | 455/522 |
| 7,038,356 | B2 | 5/2006 | Athanas | |
| 8,553,910 | B1 * | 10/2013 | Dong et al. | 381/151 |
| 2006/0239479 | A1 * | 10/2006 | Schobben et al. | 381/306 |
| 2007/0265031 | A1 * | 11/2007 | Koizumi et al. | 455/556.1 |
| 2009/0209293 | A1 * | 8/2009 | Louch | 455/566 |
| 2009/0290718 | A1 * | 11/2009 | Kahn et al. | 381/57 |
| 2010/0328033 | A1 * | 12/2010 | Kamei | 340/5.82 |
| 2011/0194230 | A1 * | 8/2011 | Hart et al. | 361/437 |
| 2012/0056801 | A1 * | 3/2012 | Bevilacqua et al. | 345/156 |
| 2012/0063632 | A1 * | 3/2012 | Aoki et al. | 381/400 |
| 2012/0182539 | A1 * | 7/2012 | Grokop et al. | 356/4.01 |
| 2012/0244917 | A1 * | 9/2012 | Hosoi et al. | 455/575.1 |
| 2014/0270217 | A1 * | 9/2014 | Ivanov et al. | 381/66 |
| 2014/0328488 | A1 * | 11/2014 | Caballero et al. | 381/58 |

FOREIGN PATENT DOCUMENTS

| | | | | |
|---|---|---|---|---|
| CN | 201750452 U | * | 2/2011 | H04M 1/02 |
| JP | 2007019898 A | * | 1/2007 | H04R 1/00 |

OTHER PUBLICATIONS

English machine translation of CN201750452 (Ko et al., Mobile Communication Terminal, published Feb. 2011).*

* cited by examiner

*Primary Examiner* — Wayne Young
*Assistant Examiner* — Mark Fischer
(74) *Attorney, Agent, or Firm* — Brake Hughes Bellermann LLP

(57) ABSTRACT

The computing device includes a speaker, a transducer configured to utilize a surface in contact with the portable computer to generate an audible sound, a detector configured to determine at least one characteristic of the surface based on at least one received sensor signal, and a controller configured to select at least one of the speaker and the transducer for audible output based on the at least one characteristic of the surface.

18 Claims, 6 Drawing Sheets

COMPUTING DEVICE UTILIZING A RESTING SURFACE AS A SPEAKER

BACKGROUND

1. Field

Embodiments relate to speaker systems for computer devices.

2. Related Art

The production of quality sound with computers (e.g., laptop computers) has not significantly changed since the introduction of these computers. Generally computers include one or more conventional (or traditional) speakers utilizing a diaphragm to generate air motion resulting in audible sound.

SUMMARY

One embodiment includes a portable computer. The portable computer includes a speaker, a transducer configured to utilize a surface in contact with the portable computer to generate an audible sound, a detector configured to determine at least one characteristic of the surface based on at least one received sensor signal, and a controller configured to select at least one of the speaker and the transducer for audible output based on the at least one characteristic of the surface.

Another embodiment includes a method for generating audible output in a computer device. The method includes determining one or more characteristic associated with a surface which the computer device is in contact with, and selecting at least one of a speaker and a transducer configured to generate vibrations on the surface such that the surface generates air motion resulting in audible sound for use as audible output of the computer device based on the determined characteristic.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limiting of the example embodiments and wherein.

Figure 1:
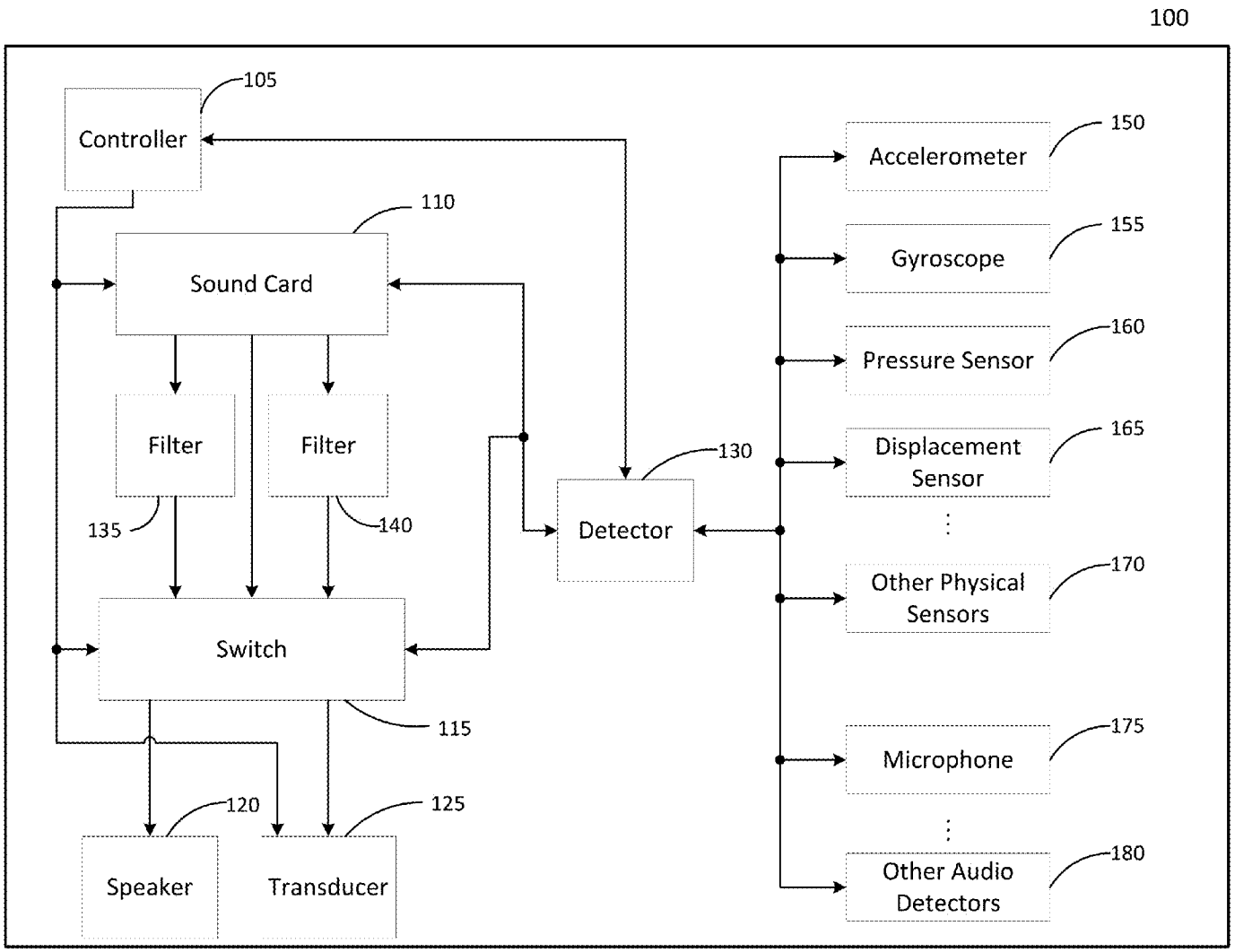
FIG. 1 illustrates a computer device according to an example embodiment.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION OF THE EMBODIMENTS

While example embodiments are may include various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

According to example embodiments a computer device (e.g., a laptop computer or a tablet computer) includes a speaker, a transducer configured to utilize a surface in contact with the portable computer to generate an audible sound, a detector configured to determine at least one characteristic of the surface based on at least one received sensor signal, and a controller configured to select at least one of the speaker and the transducer for audible output based on the at least one characteristic of the surface.

FIG. 1 illustrates a computer device according to an example embodiment. As is shown in FIG. 1, the computer device 100 includes controller 105, sound card 110, switch 115, speaker 120, transducer 125, detector 130, filter 135, filter 140, and various interconnections. The detector 130 may be communicatively coupled with accelerometer 150, gyroscope 155, pressure sensor 160, displacement sensor 165, microphone 175, other physical sensors 170, and other audio detectors 180. Although example embodiments may be described to include the aforementioned sensors and detectors, example embodiments may not include each of these sensors and detectors. Further, other sensors and detectors will be apparent to those skilled in the art. The computer device 100 may be a personal computer, a laptop, a smartphone and the like. The computing device 200 may be a part of a personal computer, a laptop, a smartphone and the like.

The controller 105 may be configured to select at least one of the speaker 120 and the transducer 125 as a speaker for the computer device 100 based on characteristics associated with a surface on which computer device 100 is set. For example, the controller 105 may receive data from detector 130 and use the data in selecting at least one of the speaker 120 and the transducer 125. The data may represent one or more characteristics associated with a surface which computer device 100 is in contact with. The one or more characteristics may indicate whether or not the surface can vibrate in response to mechanical vibrations received from an audio/mechanical vibration transducer in order to generate air vibrations representing sound to a user. For example, the data may represent hardness, density, orientation (e.g., level or not) of the surface. A level computer device 100 in contact with a hard and/or dense surface may more efficiently generate air vibrations when compared to a non-level computer device 100 in contact with a soft and/or less dense surface. For example, a level computer device 100 may be aligned with the surface such that the computer device is parallel (or substantially parallel) with the surface and in contact with the surface via, for example, the foot pads. A non-level computer device 100 may not be aligned with the surface such that the computer device is not parallel (or not substantially parallel) with the surface resulting in no or poor contact with the surface. The controller 105 may include a processor (not shown) and may execute instructions within the computer device 100. The processor may be implemented as a chipset of chips that include separate and multiple analog and digital processors. The processor may provide, for example, for coordination of the other components of the computer device 100, such as control of interfaces, applications run by computer device 100, and communication by computer device 100.

The sound card 110 may be configured to receive the input and generate output of audio signals to and from computer device 100 under control of computer programs being executed by computer device 100. The filter 135 may be configured to block and/or filter (e.g., attenuate level to an insignificant or substantially insignificant level) signals associated with a frequency range and/or block signals above and/or below a frequency value. The signals may be voltage and/or current values representing signals having an associated frequency. For example, filter 135 may be a high pass filter, a low pass filter, a band pass or a band reject filter. Settings associated with filter 135 (e.g., cut-off frequency) may be fixed or variable based on a setting from, for example, controller 105. Frequency rejections (and passes) may be sharp or sloped based on the settings.

The filter 140 may be configured to block and/or filter signals associated with a frequency range and/or block and/or filter signals above and/or below a frequency value. The signals may be voltage and/or current values representing signals having an associated frequency. For example, filter 140 may be a high pass filter, a low pass filter, a band pass or a band reject filter. Settings associated with filter 140 (e.g., cut-off frequency) may be fixed or variable based on a setting from, for example, controller 105. Frequency rejections (and passes) may be sharp or sloped based on the settings.

According to one or more example embodiments, the filter 135 may be configured as a high pass filter and the filter 140 may be configured as a low pass filter. For example, filter 140 may be configured to pass low frequency signals (e.g., below 200 Hz) and filter 135 may be configured to pass mid and high frequency signals (e.g., above 200 Hz). According to one or more example embodiments, there may be some overlap of frequencies. The filter 135 and the filter 140 may be elements of sound card 110.

The switch 115 may be configured to selectively transmit a variable current received from the sound card 110 (e.g., directly or via one or more of filters 135, 140) to at least one of the speaker 120 and the transducer 125 based on a selection signal received from the controller 105. For example, if multi-channel (multi-frequency) audio system is selected and the surface is determined to be configured to efficiently generate air vibrations, both of the speakers 120 and the transducer 125 may be selected and both the filters 135, 140 may be selected. In this case, transducer 125 may be used for low frequency response and speaker 120 may be used for mid and high frequency responses. The transducer 125 may be selected for low frequency response because transducer 125 may provide a higher quality audio at low frequencies when compared to speaker 120. Further, the user of the computer may experience haptic sensation, because the surface is used to generate the audio. The switch 115 may be an element of sound card 110. For example, if multi-channel (multi-frequency) audio system is not selected and the surface is determined to be configured to efficiently generate air vibrations, transducer 125 may be selected for use as the computer device speaker. For example, if the surface is determined not to be configured to efficiently generate air vibrations, speaker 120 may be selected regardless of whether or not multi-channel (multi-frequency) audio system is selected. As discussed above, controller 105 may make the described determinations.

The speaker 120 may be a traditional or dynamic speaker configured to receive a variable current from the sound card 110 and generate air motion based on the variable current which results in audible sounds. For example, to generate the air motion a dynamic transducer may be used. In this case, a linear motor, in which a moving diaphragm is attached to a coil which is driven by a variable current. The coil is suspended in a constant magnetic field. The current through the coil interacts with the magnetic field to generate a force, which makes the coil and diaphragm oscillate according to the current variations through the coil. The speaker 120 may be a configured to generate audio spanning substantially an entire frequency range that can be perceived by the human ear. However, according to one or more example embodiments, the speaker 120 may or may not be used to generate audio over the entire frequency range. Although a single speaker 120 is shown, example embodiments are not limited thereto.

The transducer 125 may be used as a non-traditional (e.g., an audio/mechanical vibration transducer) speaker configured to receive a variable current from the sound card 110 and generate mechanical vibrations that are transferred to another surface which in turn vibrate to generate audible sounds. As a result, the transducer 125 may generate audio sounds without the use of a moving diaphragm. For example, an audio/mechanical vibration transducer may be a device that is used to generate mechanical vibrations for transfer to a surface. The mechanical vibrations representing sound to a user. As the audio signals (e.g., variable current signals) from the sound card 110, are transmitted, the transducer converts the received signals into mechanical vibrations that can be transferred to a hard surface such that the hard surface generates air motion based on the mechanical vibrations. According to an example embodiment, the transducer 125 may be used in conjunction with speaker 120 as a multi-channel (multi-frequency) audio system. For example, transducer 125 may be used for low frequency response and speaker 120 may be used for mid and high frequency responses. Although a single speaker 120 is shown, example embodiments are not limited thereto. For example, transducer 125 may be configured to generate vibrations and transmit the vibrations to the surface which computer device 100 is in contact with via a mechanism configured to transfer the vibration (e.g., foot pads) on the computer device 100.

The detector 130 may be configured to determine characteristics associated with a surface on which computer device 100 is in contact with. The characteristics may determine whether or not the surface can generate air vibrations representing sound to a user. For example, the characteristics may include hardness, density, orientation (e.g., level or not) of the surface. A level computer device 100 in contact with a hard and/or dense surface may more efficiently generate air vibrations when compared to a non-level computer device 100 in contact with a soft and/or less dense surface. For example, a level computer device 100 may be aligned with the surface such that the computer device is parallel (or substantially parallel) with the surface and in contact with the surface via, for example, the foot pads. A non-level computer device 100 may not be aligned with the surface such that the computer device is not parallel (or not substantially parallel) with the surface resulting in no or poor contact with the surface.

For example, the detector 130 may include an associated gyroscope 155 configured to determine orientation based on how the computer device 100 is being held. For example, the gyroscope 155 may be configured to generate an indication of orientation and/or position and the indication of orientation and/or position may be used by the detector 130 to determine the computer device 100 is in contact with a flat surface (e.g., a desk or table) versus a non-flat surface (e.g., a users lap, a pillow, and the like) based on how the computer device 100 is being held. For example, if the gyroscope 155 generates a signal, to be utilized by the detector 130, which indicates the device is level within plus/minus five degrees based on the corners of the computer device 100, the detector 130 may determine the computer device is in contact with a flat and/or level surface.

For example, the detector 130 may include an associated accelerometer 150 configured to generate an indication of movement and/or position and the indication of movement and/or position may be used by the detector 130 to determine movement of the computer device 100 based on a change in position (or rate of change) of the computer device 100. For example, the accelerometer 150 may generate a signal used by the detector 130 to determine the computer device 100 is not in contact with a surface based on whether or not the computer device 100 is changing position. For example, if the accelerometer 150 generates a signal, to be utilized by the detector 130, which indicates the computer device 100 is moving at a rate of one foot per second, the detector 130 may determine the computer device is not in contact with a surface.

The characteristics may include physical characteristics (e.g., hardness and/or density). The physical characteristics may be relative characteristics (e.g., a wood table may be harder than a pillow). The characteristics may include audio characteristics (e.g., a reflected audio response).

For example, the detector 130 may include an associated pressure sensor(s) 160 (e.g., one sensor associated with each of foot pad). The detector 130 may be configured to determine a force based on a signal received from the pressure sensor(s) 160. Therefore, the detector 130 may determine individual/combined force on each foot. The detector 130 may determine if the surface is dense and/or hard enough to generate audible sounds based on the force. The determination may be a relative characteristic determination. For example, if any foot pad force is less than a threshold value and/or a sum of foot pad forces is less than a threshold value, then the detector 130 may determine the computer device 100 is in contact with a surface that can generate audible sounds. The determination may be an absolute characteristic determination. For example, the detector 130 may include a table relating detected pressure to density and/or hardness. The detector 130 may use the detected pressure to look-up density and/or hardness values in the table. If the density and/or hardness values are greater than a threshold value, the detector 130 may determine the computer device 100 is in contact with a surface that can generate audible sounds.

For example, the detector 130 may include an associated displacement sensor(s) 165 (e.g., one sensor associated with each of foot pad). The detector 130 may be configured to determine a displacement based on a signal received from the displacement sensor(s) 160. Therefore, the detector 130 may determine individual/combined displacement on each foot. The detector 130 may determine if the surface is hard enough to generate audible sounds based on the displacement. The determination may be a relative characteristic determination. For example, if any foot pad displacement is less than a threshold value and/or a sum of foot pad displacements is less than a threshold value, then the detector 130 may determine the computer device 100 is in contact with a surface that can generate audible sounds. The determination may be an absolute characteristic determination. For example, the detector 130 may include a table relating displacement to hardness. The detector 130 may use the detected displacement to look-up hardness values in the table. If the density hardness values are greater than a threshold value, the detector 130 may determine the computer device 100 is in contact with a surface that can generate audible sounds within a target or desirable frequency range.

The detector 130 may include associated other physical sensors 170 configured to generate signals indicating one or more physical characteristics to be utilized by the detector 130. The other physical sensors 170 may operate somewhat similar to those discussed above. The other physical sensors 170 may include, for example, piezoelectric devices.

Alternatively (and/or in addition), the detector 130 may use transducer 125 to generate and transmit a vibration representing a brief acoustic tone (e.g., a low frequency tone so as not to irritate the user), then an associated microphone 175 may detect an intended tone. If the intended tone is not received and/or received at a power (e.g., mW, db, dbm) below a threshold, the detector 130 may determine the computer device 100 is in contact with a surface that is not capable of generating audible sounds. The brief acoustic tone may be applied to individual foot pads in order to determine if one or more of the foot pads is in contact with a surface capable of generating audible sounds. For example, the detector 130 may instruct the controller 105 (or the sound card 110) to transmit the brief acoustic tone utilizing the sound card 110 and the transducer 125 to the surface via at least one foot pad. The microphone 175 may detect the intended tone and the detector 130 may transmit data representing the characteristics associated with the surface which computer device 100 is in contact with to the controller 105.

The detector 130 may include associated other audio detectors 180 configured to generate signals indicating one or more detected audio signal to be utilized by the detector 130. The other audio detectors 180 may operate somewhat similar to those discussed above. The other audio detectors 180 may include, for example, piezoelectric devices.

According to an example embodiment, a method includes determining one or more characteristic associated with a surface which the computer device is in contact with, and selecting at least one of a speaker and a transducer configured to generate vibrations on the surface such that the surface generates air motion resulting in audible sound for use as audible output of the computer device based on the determined characteristic.

Figure 2:
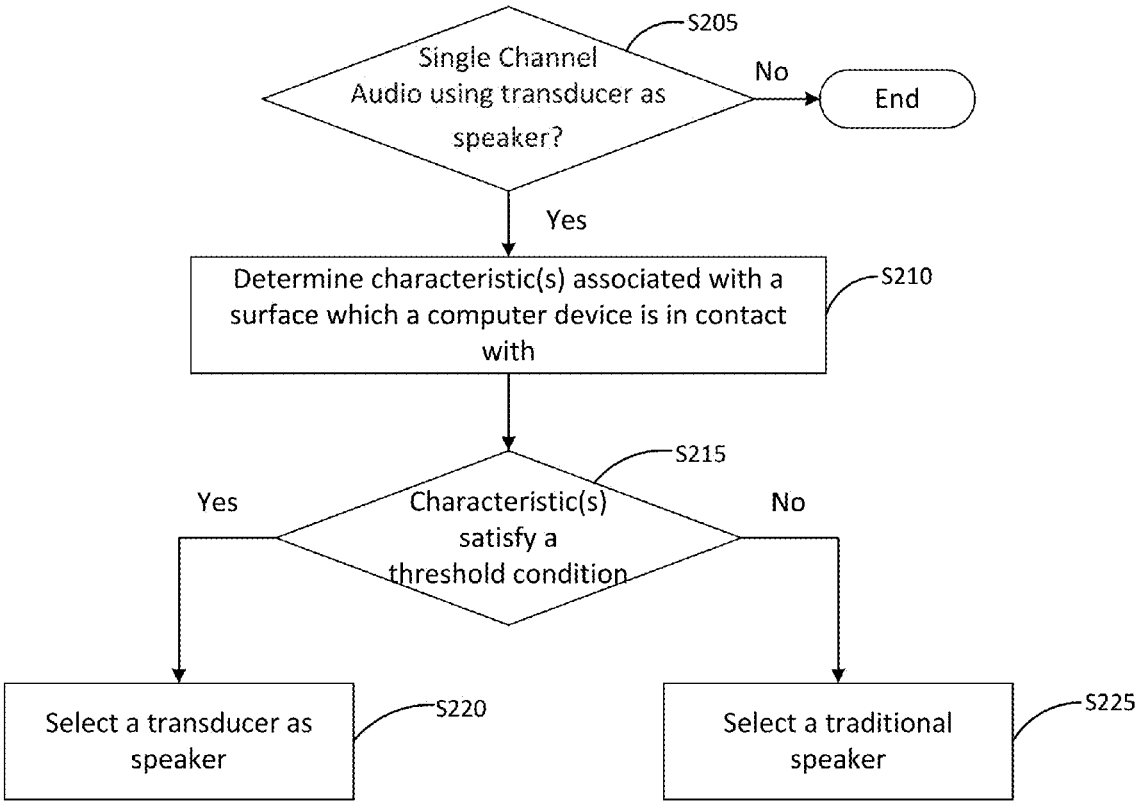
FIG. 2 illustrates a method of operating the computer device of FIG. 1 according to an example embodiment.
Figure 3:
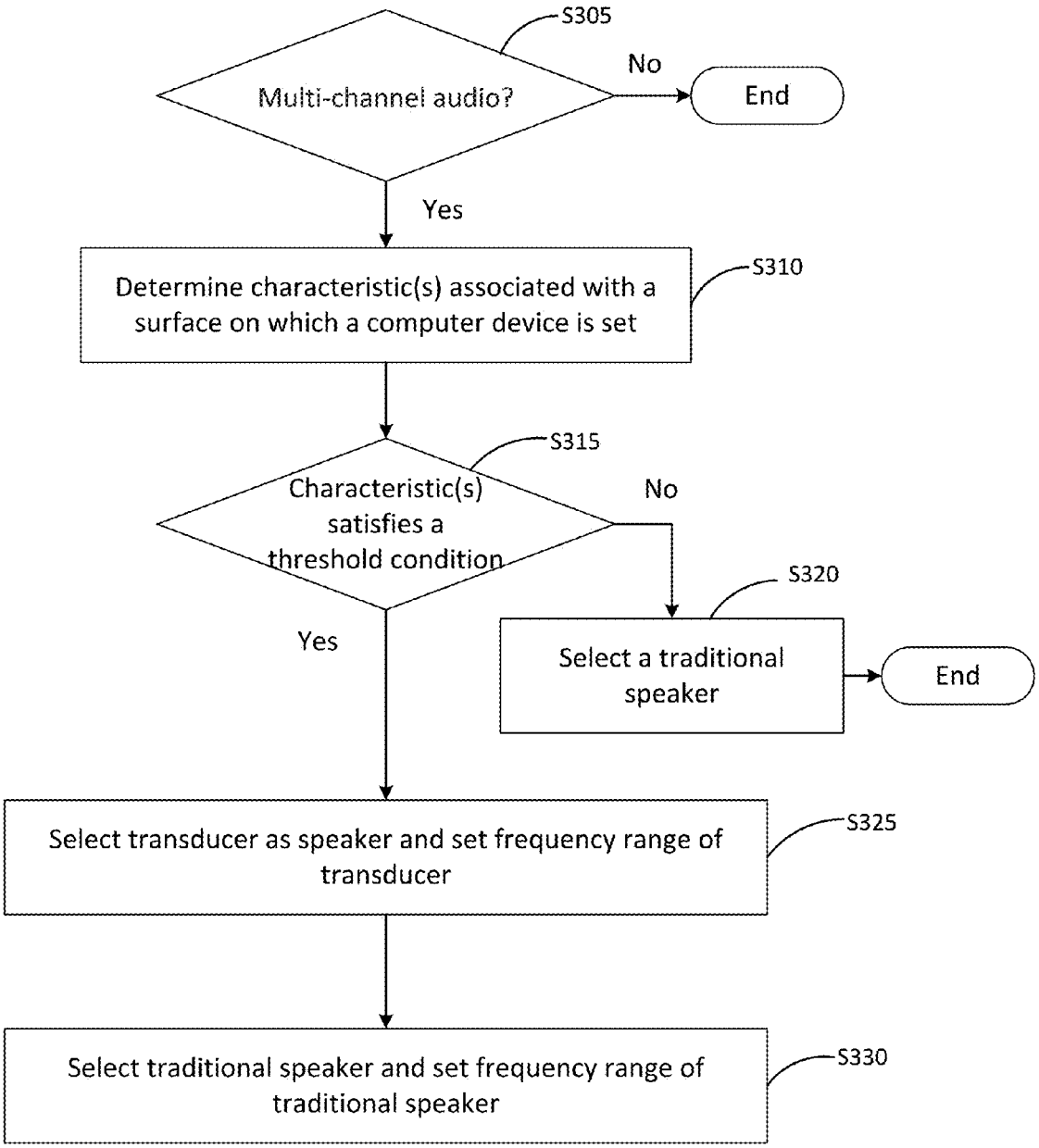
FIG. 3 illustrates a method of operating the computer device of FIG. 1 according to an example embodiment.

FIGS. 2 and 3 illustrate exemplary methods of operating the computer device of FIG. 1. The steps of FIGS. 2 and 3 may be performed by, for example, computer device 100. FIG. 2 illustrates selecting and utilizing a non-traditional speaker (e.g., transducer 125). FIG. 3 illustrates selecting and utilizing both traditional (e.g., speaker 120) and non-traditional (e.g., transducer 125) speakers. Selecting a traditional (e.g., speaker 120) is a simple one step process and is not described herein for the sake of brevity.

In step S205 a controller (e.g., controller 105) determines if single channel audio utilizing a transducer as speaker is selected. If single channel audio utilizing a transducer as speaker is selected processing continues to step S210. Otherwise, processing ends. For example, a user of computer 100 may select single channel audio utilizing a transducer as speaker via a user interface.

In step S210 a detector (e.g., detector 130) determines one or more characteristics associated with a surface on which a computer device (e.g., computer device 100) is in contact with. As discussed above, detector 130 may utilize an accelerometer, force sensors and/or brief acoustic tones to determine characteristics associated with the surface. The characteristics may determine whether or not the surface can generate air vibrations representing sound to a user. For example, the characteristics may include hardness of the surface, density of the surface, orientation (e.g., level or not) in relation to the surface. The detector may also determine a movement of the computer device in order to determine if the computer device is in contact with the surface.

In step S215 if at least one of the one or more characteristics satisfies a condition processing continues to step S220. Otherwise, processing continues to step S225. For example, the detector 130 may sense force on an individual foot and/or generate a combined force based on the individual force on each foot. For example, if any foot pad force is less than a threshold force and/or a sum of foot pad forces is less than a threshold force, then the detector 130 may determine the computer device 100 is in contact with a soft and/or less dense surface. For example, if the gyroscope indicates the device is level within plus/minus five degrees based on the corners of the computer device 100 and the computer device is not moving, the detector 130 may determine the computer device is in contact with a flat surface. For example, the detector may have an associated microphone to detect an intended tone based on the brief acoustic tones. If the intended tone is not received and/or received at a power below a threshold, the detector 130 may determine the computer device 100 is in contact with a soft and/or less dense surface.

In step S220 the controller (e.g., controller 105) selects a non-traditional speaker. For example, if the detector determines the computer device 100 is level, is not moving, is in contact with a hard and/or on a dense surface, the controller selects transducer 125. As a result, the computer device 100 utilizes a non-traditional speaker for audio output.

In step S225 the controller selects a traditional speaker. For example, if the detector determines the computer device 100 is not level, is moving, is in contact with a soft and/or on a less dense surface, the controller selects speaker 120 and the process ends. As a result, the computer device 100 utilizes a traditional speaker for audio output. The computer device 100 may utilize the traditional speaker because the surface the computer device 100 is in contact with may not be capable of generating audible sound when vibrated by a signal representing an audible sound.

According to an example embodiment, transducer 125 may be used in conjunction with speaker 120 as a multi-channel (multi-frequency) audio system. For example, transducer 125 may be used for low frequency response (e.g., below 200 Hz) and speaker 120 may be used for mid and high frequency responses (e.g., above 200 Hz).

As shown in FIG. 3, in step S305, the controller determines if multi-channel audio is being used. For example, a user of the computer device 100 may select multi-channel audio via a user interface. For example, the computer device 100 may select multi-channel audio based on the type of audio to be output. If multi-channel audio is being used processing continues to step S310. Otherwise, processing ends.

In step S310 a detector (e.g., detector 130) determines one or more characteristics associated with a surface on which a computer device (e.g., computer device 100) is in contact with. As discussed above, detector 130 may utilize an accelerometer, force sensors and/or brief acoustic tones to determine characteristics associated with the surface. The characteristics may determine whether or not the surface can generate air vibrations representing sound to a user. For example, the characteristics may include hardness of the surface, density of the surface, orientation (e.g., level or not) in relation to the surface. The detector may also determine a movement of the computer device in order to determine if the computer device is in contact with the surface.

In step S315 if at least one of the one or more characteristics satisfies a condition processing continues to step S325. Otherwise, processing continues to step S320. For example, the detector 130 may sense force on an individual foot and/or generate a combined force based on the individual force on each foot. For example, if any foot pad force is less than a threshold force and/or a sum of foot pad forces is less than a threshold force, then the detector 130 may determine the computer device 100 is in contact with a soft and/or less dense surface. For example, if the gyroscope indicates the device is level within plus/minus five degrees based on the corners of the computer device 100 and the computer device is not moving, the detector 130 may determine the computer device is in contact with a flat surface. For example, the detector may have an associated microphone to detect an intended tone based on the brief acoustic tones. If the intended tone is not received and/or received at a power below a threshold, the detector 130 may determine the computer device 100 is in contact with a soft and/or less dense surface.

In step S320 the controller selects a traditional speaker. For example, if the detector determines the computer device 100 is not level, is moving, is in contact with a soft and/or on a less dense surface, the controller selects speaker 120 and the process ends. As a result, the computer device 100 utilizes a traditional speaker for audio output. The computer device 100 may utilize the traditional speaker because the surface the computer device 100 is in contact with may not be capable of generating audible sound when vibrated by a signal representing an audible sound.

In step S325 the controller enables the non-traditional speaker and adjusts a frequency range of the non-traditional speaker. For example, the controller 105 may activate a filter (e.g., filter 140) to filter the audio signal generated for and transmitted to the transducer 125. The controller may also instruct a switch (e.g., switch 115) to select the filter as audio input. For example, the controller 105 may set filter 140 as a low pass filter with a maximum frequency setting of, for example, 200 MHz. Alternatively, the controller 105 may set filter 140 as a band pass filter with a maximum frequency setting of, for example, 200 MHz and a minimum frequency setting of, for example, 20 MHz.

In step S330 the controller enables the traditional speaker and adjusts a frequency range of the traditional speaker. For example, the controller 105 may activate a filter (e.g., filter 135) to filter the audio signal generated for and transmitted to the traditional speaker 120. The controller may also instruct a switch (e.g., switch 115) to select the filter as audio input. For example, the controller 105 may set filter 135 as a high pass filter with a minimum frequency setting of, for example, 200 MHz. As a result, the computer device 100 operates as a multi-channel (multi-frequency) audio system with the non-traditional speaker (e.g., transducer 125) outputting audio signals with a frequency below 200 MHz and the traditional speaker (e.g., speaker 120) outputting audio signals with a frequency above 200 MHz.

Figure 4A:
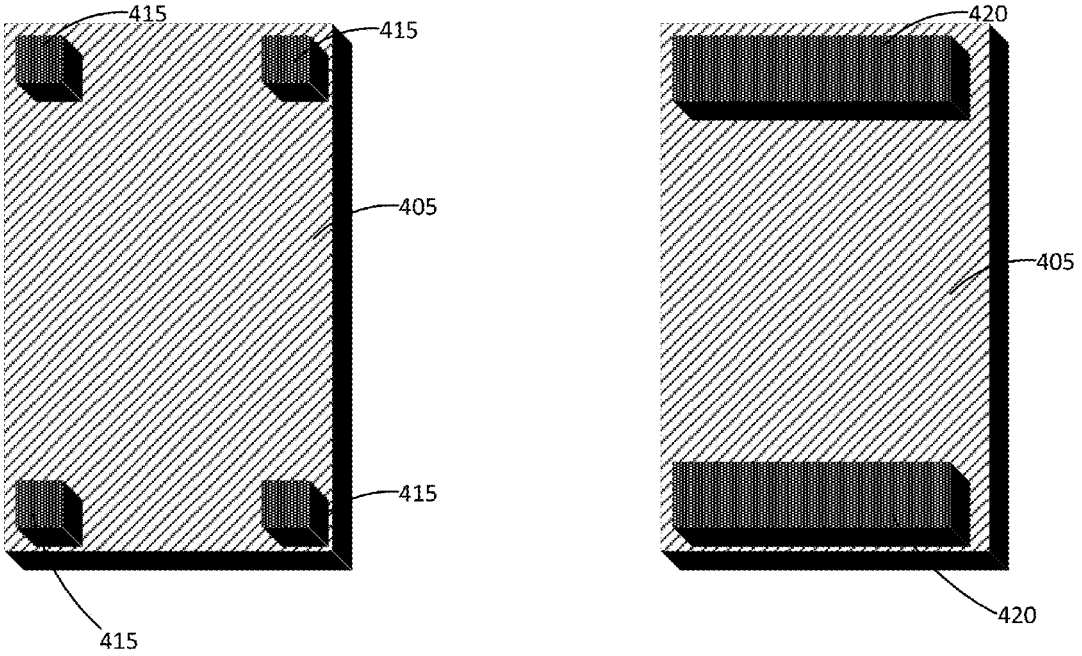
FIGS. 4A-4D illustrate a computer device showing representative positions of various components according to one or more example embodiments.

FIG. 4A-4D illustrates a computer device showing representative positions of various components (associated with the computer device 100 of FIG. 1) according to one or more example embodiments. As shown in FIG. 4A, an outside bottom view 405 of a computer device (e.g. computer device 100) illustrates two exemplary footpad configurations. Although two configurations are shown, example embodiments are not limited there to.

The first configuration shows four footpads 415, one at each corner of the computer device. All or a subset of the footpads 415 may me utilized in, for example, determining if the computer device is level. For example, the footpads 415 may be associated with the pressure sensor 160 and/or the displacement sensor 165. For example, if signals received by the detector 130 from the pressure sensor 160 and/or the displacement sensor 165 indicate three or more of the footpads 415 are in contact with a hard surface, the detector 130 may determine the computer device 100 is substantially parallel with the surface and as a result determine the computer device 100 is level. Otherwise, the detector 130 may determine the computer 100 is not level. Further, the transducer 125 may be coupled to one or more of the footpads 415.

The second configuration shows two footpads 420, one at each end of the computer device. This configuration may be used on a tablet computer, for example. The footpads 420 may be utilized in, for example, determining if the computer device is level. For example, the footpads 420 may be associated with the pressure sensor 160 and/or the displacement sensor 165. For example, if signals received by the detector 130 from the pressure sensor 160 and/or the displacement sensor 165 indicate both of the footpads 420 are in contact with a hard surface, the detector 130 may determine the computer device 100 is substantially parallel with the surface and as a result determine the computer device 100 is level. Otherwise, the detector 130 may determine the computer 100 is not level. Further, the transducer 125 may be coupled to one or more of the footpads 415.

Figure 4B:
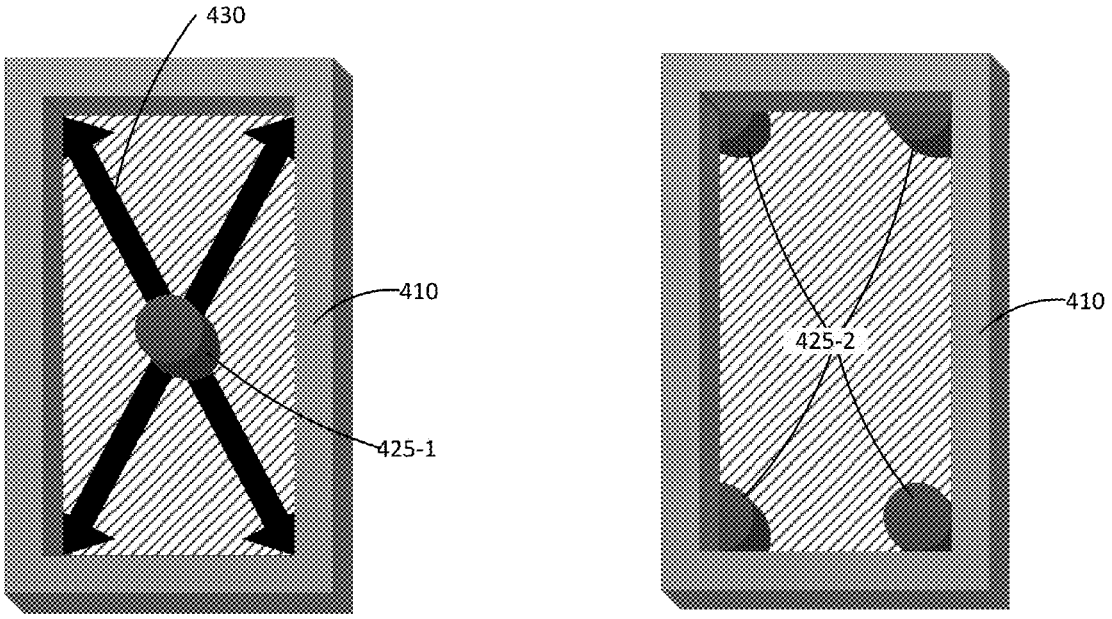

FIG. 4B shows an inside bottom view 410 of a computer device (e.g. computer device 100) which illustrates two exemplary configurations for using transducer 125 as a computer speaker. Although two configurations are shown, example embodiments are not limited there to. For example, in the first configuration there is one speaker position 425-1. In the first configuration, there is a mechanical conduit 430 from the speaker position 425-1 to the footpads 415, 420 at each corner of the computer device. For example, in the second configuration there are four positions 425-2. In the second configuration, the speaker positions are in contact with each footpad 415, 420. Further, in the second configuration sensors (e.g., pressure sensors 160 and/or displacement sensors 165 may be in positions 425-2 (and may be coupled to one or more foot pads 415, 420).

Figure 4C:
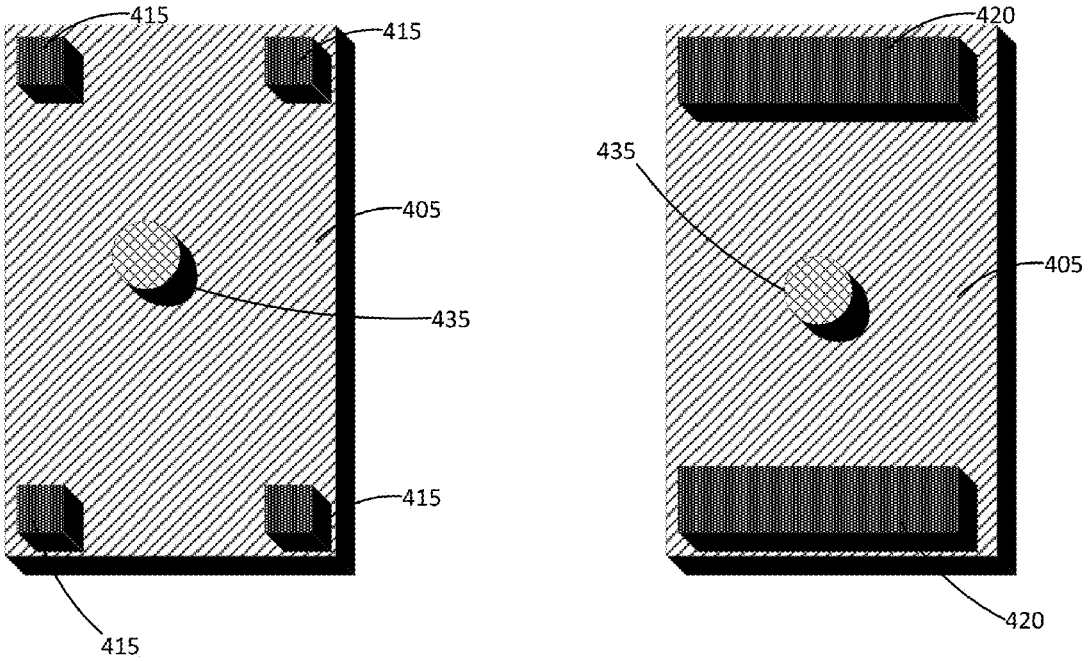
Figure 4D:
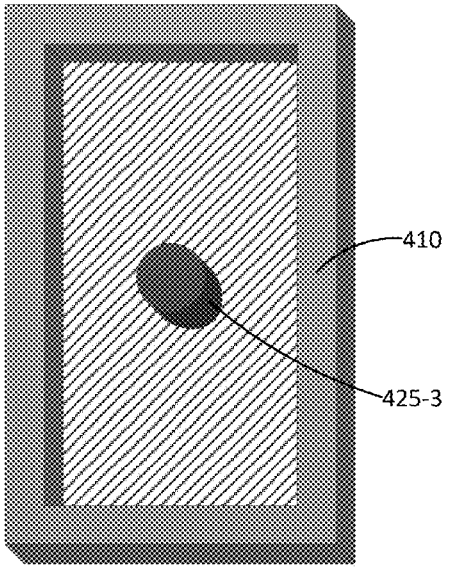

As shown in FIG. 4C, an outside bottom view 405 of a computer device (e.g. computer device 100) illustrates two exemplary footpad configurations together with another device 435 position. Although two configurations are shown, example embodiments are not limited thereto. FIG. 4D shows an inside bottom view 410 of a computer device (e.g. computer device 100) which illustrates an inside position of the another device 435.

The another device 435 may be, for example a mechanical vibration coupling, a displacement device or a pressure device. For example, position 425-3 may show a position for transducer 125 such that the vibration coupling transfers the mechanical vibrations from the transducer 125 to the surface. Although positions 425-1, 425-2 and 425-3 show specific positions for devices, one skilled in the art will recognize that the positions are representative and example embodiments are not limited as such. For example, the device positions may be combined and/or a plurality of position 425-3 may be within the scope of example embodiments.

Figure 5:
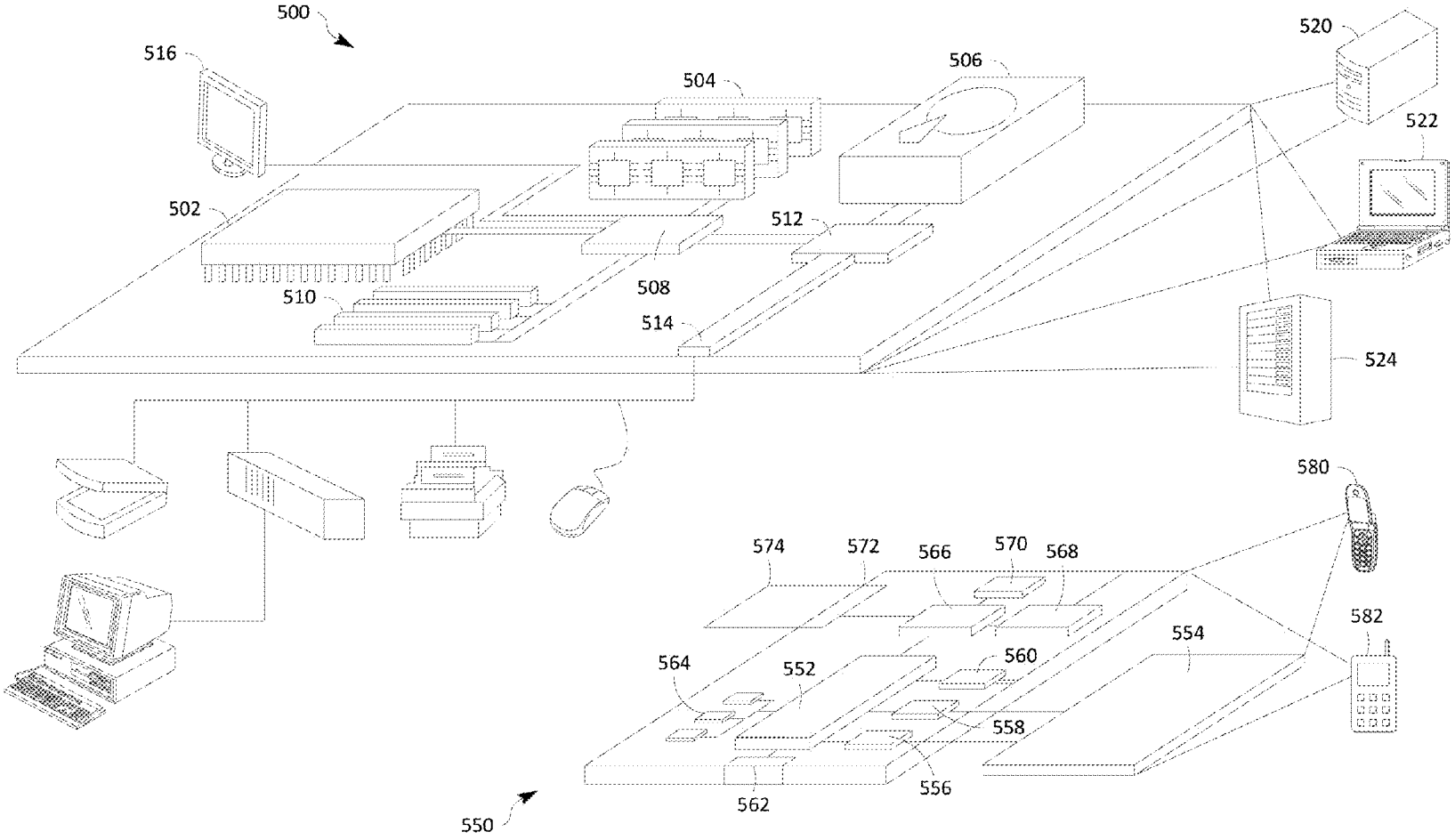
FIG. 5 illustrates a block diagram of a system in accordance with an example embodiment.

FIG. 5 illustrates a block diagram of a system in accordance with an example embodiment. FIG. 5 shows an example of a generic computer device 500 and a generic mobile computer device 550, which may be used with the techniques described herein. Computing device 500 may represent various forms of digital computers, such as laptops, desktops, workstations, personal digital assistants, servers, blade servers, mainframes, and other appropriate computers. Computing device 500 may include the features and elements described above with regard to FIGS. 1 and 2. For example, computing device 500 may include and/or represent at least computer device 100.

Computing device 550 may represent various forms of mobile devices, such as personal digital assistants, cellular telephones, smart phones, and other similar computing devices. Computing device 550 may include the features and elements described above with regard to FIGS. 1 and 2. The components shown here, their connections and relationships, and their functions, are meant to be exemplary only, and are not meant to limit implementations of example embodiments described and/or claimed in this document. For example, computing device 550 may include and/or represent at least computer device 100.

Computing device 500 includes a processor 502, memory 504, a storage device 506, a high-speed interface 508 connecting to memory 504 and high-speed expansion ports 510, and a low speed interface 512 connecting to low speed bus 514 and storage device 506. Each of the components 502, 504, 506, 508, 510, and 512, are interconnected using various busses, and may be mounted on a common motherboard or in other manners as appropriate. The processor 502 can process instructions for execution within the computing device 500 (e.g., process instructions associated with the method described above with regard to FIG. 2), including instructions stored in the memory 504 or on the storage device 506 to display graphical information for a graphical user interface (GUI) on an external input/output device, such as display 516 coupled to high speed interface 508. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system, etc.).

The memory 504 stores information within the computing device 500. In one implementation, the memory 504 includes a volatile memory unit or units. In another implementation, the memory 504 includes a non-volatile memory unit or units. The memory 504 may also be another form of computer-readable medium, such as a magnetic or optical disk.

The storage device 506 is configured to provide mass storage for the computing device 500. In one implementation, the storage device 506 may be or may contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain (e.g., store) instructions that, when executed, perform one or more methods, such as those described above. The information carrier is a computer- or machine-readable medium, such as the memory 504, the storage device 506, or memory on processor 502.

The high speed controller 508 manages bandwidth-intensive operations for the computing device 500, while the low speed controller 512 manages lower bandwidth-intensive operations. Such allocation of functions is exemplary only. In one implementation, the high-speed controller 508 is coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, computing device 500 may be implemented in a personal computer such as a laptop computer 522. Alternatively, components from computing device 500 may be combined with other components in a mobile device (not shown), such as device 550. Each of such devices may contain one or more of computing device 500, 550, and an entire system may be made up of multiple computing devices 500, 550 communicating with each other.

Computing device 550 includes a processor 552, memory 564, an input/output (I/O) device such as a display 554, a communication interface 566, and a transceiver 568, among other components. The device 550 may also be provided with a storage device, such as a micro-drive or other device, to provide additional storage. Each of the components 550, 552, 564, 554, 566, and 568, are interconnected using various buses, and several of the components may be mounted on a common motherboard or in other manners as appropriate.

The processor 552 can execute instructions within the computing device 550 (e.g., process instructions associated with the method described above with regard to FIG. 2), including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

Processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provide, for example, for wired communication in some implementations, or for wireless communication in other implementations, and multiple interfaces may also be used.

The memory 564 stores information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 564, expansion memory 574, or memory on processor 552, that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert the spoken information to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

The computing device 550 may be implemented in a number of different forms, as shown in the figure. For example, computing device 550 may be implemented as a cellular telephone 580. Computing device 550 may also be implemented as part of a smart phone 582, personal digital assistant, or other similar mobile device.

Some of the above example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed above, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a storage medium. A processor(s) may perform the necessary tasks.

Specific structural and functional details disclosed herein are merely representative for purposes of describing example embodiments. Example embodiments may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

It should also be noted that in some alternative implementations, the functions/acts noted may occur out of the order noted in the figures. For example, two figures shown in succession may in fact be executed concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the above example embodiments and corresponding detailed description are presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the above illustrative embodiments, reference to acts and symbolic representations of operations (e.g., in the form of flowcharts) that may be implemented as program modules or functional processes include routines, programs, objects, components, data structures, etc., that perform particular tasks or implement particular abstract data types and may be described and/or implemented using existing hardware at existing structural elements. Such existing hardware may include one or more Central Processing Units (CPUs), digital signal processors (DSPs), application-specific-integrated-circuits, field programmable gate arrays (FPGAs) computers or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note also that the software implemented aspects of the example embodiments are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

Lastly, it should also be noted that whilst the accompanying claims set out particular combinations of features described herein, the scope of the present disclosure is not limited to the particular combinations hereafter claimed, but instead extends to encompass any combination of features or embodiments herein disclosed irrespective of whether or not that particular combination has been specifically enumerated in the accompanying claims at this time.

What is claimed is:

1. A portable computer, comprising:

a speaker;

a transducer configured to utilize a surface in contact with the portable computer to generate an audible sound;

a sensor configured to generate a sensor signal representing a pressure associated with the surface;

a detector configured to determine at least one of a hardness value or a density value corresponding to the pressure; and a controller configured to control the transducer for audible output based on the at least one of the hardness value or the density value and a threshold value.

2. The portable computer of claim 1, wherein the sensor is a pressure sensor.

3. The portable computer of claim 1, wherein the sensor is a displacement sensor.

4. The portable computer of claim 1, wherein the at least one of the hardness value or the density value is looked-up in a table based on the pressure.

5. The portable computer of claim 1, wherein the speaker includes a diaphragm configured to generate air motion resulting in audible sound, the transducer is configured to generate vibrations on the surface such that the surface generates air motion resulting in audible sound without the use of a diaphragm.

6. The portable computer of claim 1, wherein the hardness value is a relative hardness value.

7. The portable computer of claim 1, wherein the density value is a relative density value.

8. The portable computer of claim 1, wherein the sensor signal is a first sensor signal, the threshold value is a first threshold value, the portable computer, further comprising:

a gyroscope configured to generate a second sensor signal indicates an orientation of the surface relative to the portable computer, wherein the detector is configured to generate a level characteristic based on whether or not the portable computer is level in relation to the surface based on the orientation, and the controller selects the transducer for audible output based on the level characteristic and a second threshold value.

9. The portable computer of claim 1, wherein the sensor signal is a first sensor signal, the threshold value is a first threshold value, the portable computer, further comprising:

an accelerometer configured to generate a second sensor signal indicates a movement of the portable computer, wherein the detector is configured to generate a movement characteristic based on whether or not the portable computer is moving relative to the surface based on the movement of the portable computer, and the controller selects the transducer for audible output based on the movement characteristic and a second threshold value.

10. The portable computer of claim 1, wherein the speaker includes a diaphragm configured to generate air motion resulting in audible sound, the transducer is configured to generate vibrations on the surface such that the surface generates air motion resulting in audible sound without the use of a diaphragm.

11. The portable computer of claim 1, wherein the threshold value is a first threshold value, the portable computer further comprising:

a microphone configured to detect a tone representing an audible characteristic; wherein the controller is configured to generate an acoustic tone utilizing the transducer, and the detector determines if the surface is capable of generating audible sounds based on the detected tone, the generated acoustic tone and a second threshold value.

12. The portable computer of claim 1, further comprising at least one pad located on an exterior of the portable computer and configured to be in direct contact with the surface, wherein the transducer is configured to generate vibrations on the surface using the at least one pad such that the surface generates air motion resulting in audible sound.

13. The portable computer of claim 1, further comprising:

a first filter configured to pass signals associated with a first frequency range;

a second filter configured to pass signals associated with a second frequency range, the first frequency range being different from the second frequency range; and a switch configured to selectively select the output of the first filter as input to the speaker and the output of the second filter as input to the transducer based on a selection signal from the controller.

14. The portable computer of claim 1, wherein the controller is further configured to:

determine if multi-channel audio is selected based on a user selection;

select both the speaker and the transducer if multi-channel audio is selected and if the surface is capable of generating audible sounds, wherein the speaker outputs audible sounds associated with a first frequency range;

the transducer outputs vibrations associated with a second frequency range, the first frequency range being different from the second frequency range.

15. A method for generating audible output in a computer device, the method comprising:

determining, by a detector of the computer device based on a received sensor signal, at least one of a hardness value or a density value corresponding to at least one characteristic associated with a surface which the computer device is in contact with, the at least one characteristic including a pressure; and controlling, by a controller of the computer device, a transducer configured to generate vibrations on the surface such that the surface generates air motion resulting in audible sound for use as audible output of the computer device based on the at least one of the hardness value or the density value corresponding to the at least one characteristic of the surface and a threshold value.

16. The method of claim 15, wherein the transducer is selected if the surface is capable of generating audible sounds based on the characteristic.

17. The method of claim 15, wherein a speaker is selected if the surface is not capable of generating audible sounds based on the characteristic.

18. The method of claim 15, further comprising:

determining if multi-channel audio is selected based on a user selection;

selecting both a speaker and the transducer if multi-channel audio is selected and if the surface is capable of generating audible sounds based on the characteristic, wherein the speaker outputs audible sounds associated with a first frequency range;

the transducer outputs vibrations associated with a second frequency range, the first frequency range being different from the second frequency range.

* * * * *

UNITED STATES PATENT AND TRADEMARK OFFICE

CERTIFICATE OF CORRECTION

PATENT NO. : 9,264,802 B2
APPLICATION NO. : 13/713904
DATED : February 16, 2016
INVENTOR(S) : Leng Ooi et al.

It is certified that error appears in the above-identified patent and that said Letters Patent is hereby corrected as shown below:

In the claims

Column 15, line 8, claim 8, delete "indicates" and insert -- that indicates --, therefor.

Column 15, line 23, claim 9, delete "indicates" and insert -- that indicates --, therefor.

Signed and Sealed this
Third Day of May, 2016

Michelle K. Lee

Michelle K. Lee
*Director of the United States Patent and Trademark Office*